United States Patent [19]

McGrail et al.

[11] Patent Number: 4,564,974

[45] Date of Patent: Jan. 21, 1986

[54] SECURITY HINGE

[76] Inventors: John F. McGrail, Suite C-197, 7701 Warner Ave., Huntington Beach, Calif. 92647; Roger F. Kershaw, 14691 Canterbury Ave., Tustin, Calif. 92680

[21] Appl. No.: 596,395

[22] Filed: Apr. 3, 1984

[51] Int. Cl.[4] ..... E05D 11/10

[52] U.S. Cl. ..... 16/353; 16/349

[58] Field of Search ..... 16/328, 329, 330, 345, 16/347, 348, 349, 353; 292/173, 188; 74/527

[56] References Cited

U.S. PATENT DOCUMENTS

| | | | |
|---|---|---|---|
| 121,309 | 11/1871 | Amos | 16/353 |
| 485,613 | 11/1892 | Deane | 16/353 |
| 1,868,342 | 7/1932 | Yurkovitch | 16/353 |
| 2,045,837 | 6/1936 | Creber | 16/353 |
| 2,757,033 | 7/1956 | Noca | 292/173 |
| 2,900,204 | 8/1959 | Pelcin | 292/173 |
| 3,744,085 | 7/1973 | Griego | 16/144 |
| 3,874,029 | 4/1975 | McCullough | 16/144 |
| 4,072,331 | 2/1978 | Butterfield et al. | 292/173 |

*Primary Examiner*—Fred Silverberg

*Attorney, Agent, or Firm*—Hubbard, Stetina & Brunda

[57] ABSTRACT

A door or cabinet hinge which locks in one position—normally the closed position. It may be locked and unlocked from outside. Operated by a conventional keyed cylinder lock passing through the door and actuating an arm, the device has a lock pin parallel to and spaced outside the hinge pin. The lock pin moves along its axis to slide integral protruding keys into corresponding slots in the knuckles surrounding the hinge pin. In the unlocked position the keys lie entirely in one knuckle, in the locked position they span between knuckles and prevent rotation thereof. A yoke connects the actuating arm to the lock pin.

2 Claims, 9 Drawing Figures

SECURITY HINGE

BACKGROUND OF THE INVENTION

1. Field of the Invention

Most doors open and close on freely-swinging hinges. This invention is in the field of devices associated with the hinge or integral with it which enable the free swinging to be positively stopped, so the door will not swing. Normally it would be used to lock the door shut. The security hinge may be used alone or in conjunction with a lock on the handle side of the door. If the latter, both sides of the door are locked independently of each other.

2. Description of Prior Art

Most hinges do not lock. However, the advantages of having a hinge capable of being locked are such that prior art on the subject exists. These range from Walters (U.S. Pat. No. 3,711,894) who essentially builds a miniature lock into the hinge pin, the bolt of which pins together the annular portions surrounding the hinge pin (here called knuckles) to McCullough (U.S. Pat. No. 3,874,029) and Griego (U.S. Pat. No. 3,744,085) both of which slide the hinge pin axially to accomplish the locking action. Since the hinge pin is supporting the door, the need to slide it is a serious drawback to these devices as a considerable force may be required to move the locking parts into full engagement. This would be particularly true after wear had occurred or after some corrosion or foreign matter had been deposited within the mechanism. A further drawback to both the latter devices is the difficulty of assembly, making it necessary for the carpenter mounting the door either to mount the hinge without disassembling it, or to learn its proper assembly. McCullough's lock relies on a transverse pin through the hinge pin for its holding power. Thus the lock could be overpowered or broken once the knob side of the door had been opened.

As is pointed out in the following, these limitations and disadvantages of the prior art are avoided by our invention.

SUMMARY OF THE INVENTION

A hinge is normally made of three parts, two leaves which attach to the door and jamb respectively and a hinge pin. The part of the leaves which protrudes laterally beyond the thickness of the door, and is formed into an interrupted cylinder to receive the hinge pin, is called the knuckle of its respective leaf. In our invention, the knuckles of both leaves contain slots through one wall, so arranged that when the hinge is in the position at which it is to be locked the slots in the door leaf knuckle are lined up (open end to open end) with the slot in the jamb leaf knuckle. Both slots are substantially shorter than the cylindrical height of their respective knuckles. The slots are not the same length, that is one knuckle being relatively short and that in the other knuckle being relatively long. A lock pin external to the hinge contains at least one protrusion or key or tang which extends laterally into the above-mentioned slots. The protrusion height is slightly less than the length of the relatively long slot, its width being slightly narrower than the slots's width. Thus the lock pin can be in a second axial position with its protrusion spanning portions of both slots, or in a first axial position such that its protrusion lies entirely within whichever knuckle has the relatively long slot. The former position locks the hinge against rotation; the latter allows free rotation. As the lock pin is moved from one position to the other, it is guided and spaced by a sleeve portion of a lock pin guide. Means for retaining the lock pin in the chosen position may take a variety of forms.

One object of the invention is to allow the locking and unlocking to be done from the closed side of the door. This is accomplished by mounting a conventional rotating-cylinder lock through the door. On the hinge pin side, an arm extends sideways toward the end of the lock pin. By using a yoke between the arm and the pin, rotation of the arm may be made to slide the lock pin between its locked and unlocked position. A variety of yoke designs are possible to accomplish this and, if desired, to disengage the cylinder lock so the lock pin can be manually operated.

Another object is to provide a simple, direct, strong lock to the hinge. Multiple protrusions on the lock pin and slot pairs in the knuckles may be used to effect this.

Another object is to make the installation and assembly as conventional as possible, even interchangeable with conventional hinges.

DETAILED DESCRIPTION OF THE INVENTION

Our invention is best described in two stages. FIGS. 1 through 5 cover the details of the security hinge proper, while FIGS. 6 through 9 show the mounting and in particular the parts which enable it to be activated from the far side of the door.

Figure 1:
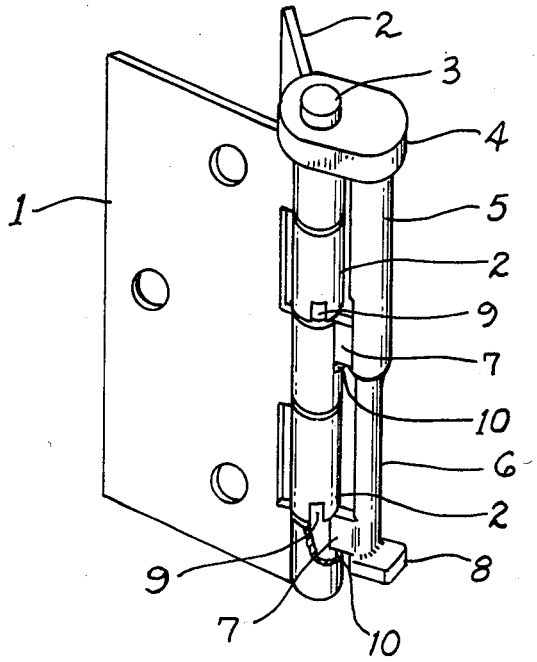
FIG. 1 is a perspective view of the hinge, omitting the portion comprising the external lock.
Figure 3:
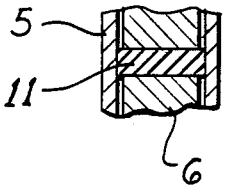
FIG. 3 is a detail of the retaining means in the preferred embodiment.
Figure 2:
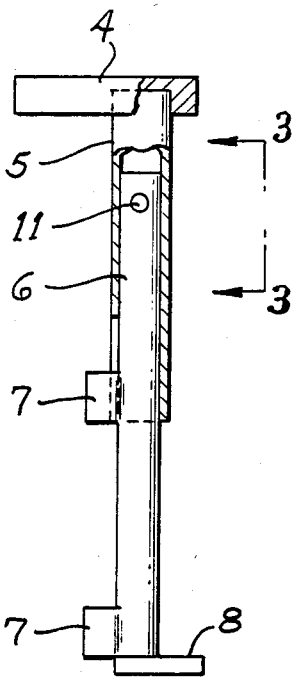
FIG. 2 shows only the lock pin and lock pin guide, in a side view.

In FIG. 1 is shown hinge leaves 1 and 2 including the conventional alternating knuckles and hinge pin 3. The lock pin guide has two parts which would normally be integral or permanently assembled, spacer/support 4 and sleeve 5. The latter parts are shown in more detail in FIG. 2. Lock pin 6 incorporating protrusion 7 are also visible in both FIG. 1 and FIG. 2, operating handle 8 would normally be formed on or attached to the assembly. Thus elements 6, 7 and 8 are collectively called the lock pin. Slots 9 and 10 pass through one wall of the knuckle as is best seen by comparing the solid and cutaway portions of FIG. 1 adjacent protrusions (or keys) 7. As shown slot 9 is shorter than slot 10 and is part of a knuckle from leaf 2. This may be seen more clearly in FIG. 5.

Item 11 is an elastomeric plug, located in lock pin 6 and bearing with both ends against the inner diameter of guide sleeve 5. It is the preferred embodiment of means to retain lock pin 5 at whichever axial position it is urged to by force applied to handle 8 of FIG. 1 and 2. Various other means, such as magnets, setscrews, an O ring or a spring loaded detent could serve the same purpose. The plug 11 is inexpensive and durable, and its position can be changed by applying appropriate forces to handle 8.

Figure 4:
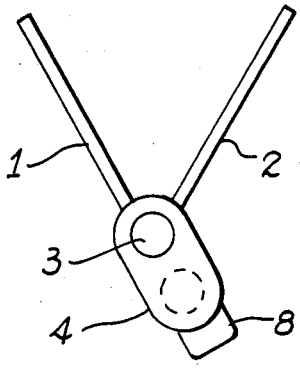
FIG. 4 is a top view of the assembled hinge.
Figure 5:
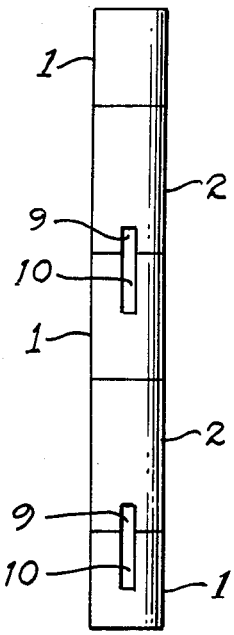
FIG. 5 is another partial view showing the knuckle portion only, at a rotational position suitable for engaging the lock.

The relationship between spacer/support 4 and hinge pin 3 is shown again in FIG. 4.

In all the foregoing discussion the long slot 10 has been in the knuckle of leaf 1 which is attached to the door. This means that spacer/support 4 turns when the door opens, since it is driven by the engagement of protrusions 7 with slots 10. That arrangement is optional; slots 10 could as well be in the knuckles of leaf 2 and remain fixed in rotational position as the door opens.

Figure 6:
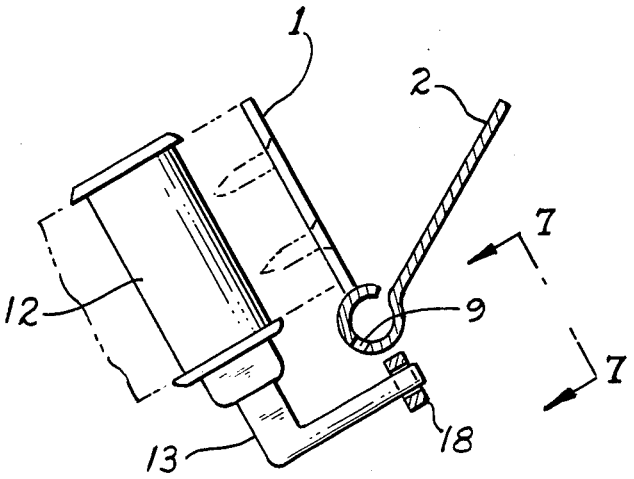
FIG. 6 shows parts of the device from above, including one version of a yoke to actuate the locking feature from a cylinder lock.
Figure 7:
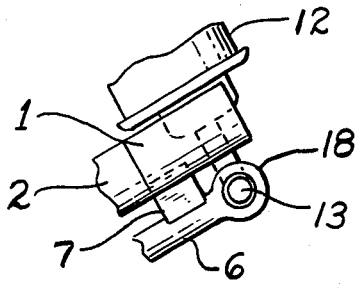
FIG. 7 is a side elevation of portions of the yoke shown in FIG. 6.

FIG. 6 shows lock cylinder 12 penetrating the door is so to allow operation from outside. Actuating arm 13 is attached to the shaft of lock cylinder 12 such that when the key is turned it rotates. In FIG. 6 is shown the preferred embodiment of yoke connecting actuating arm 13 with lock pin 6. This design omits handle 8 and replaces it with an eye-containing yoke 18 through which eye a part of actuating arm 13 passes. The arrangement is further shown in FIG. 7. Leaf 2 is shown in cross section in FIG. 6 to emphasize the lack of alignment of slot 9 when the door is partly open.

Figure 8:
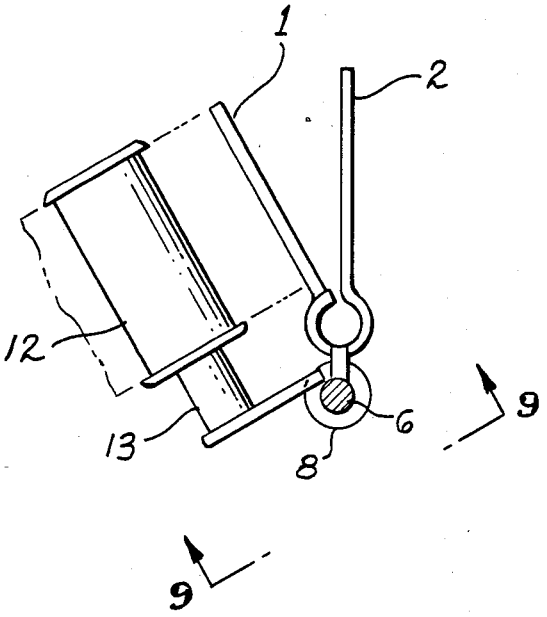
FIG. 8 is similar to FIG. 6, but shows another version of the yoke. It also shows the lock pin as it would be if the deeply slotted knuckle were on the jamb.
Figure 9:
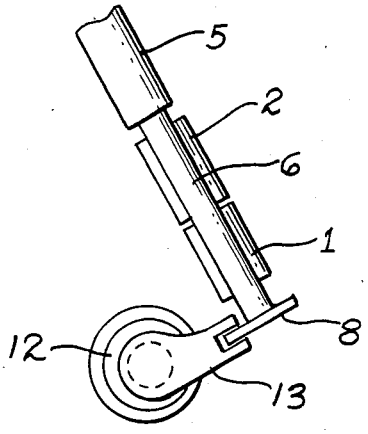
FIG. 9 is a side elevation view of portions of the device as shown in FIG. 8.

FIG. 8 also shows a partly open door, but in a security hinge configuration such that slots 10 are in leaf 2 so it is leaf 1 and slot 9 (not shown) which are out of alignment. Should this configuration be used, actuating arm 13 must be yoked to lock pin 6 in a manner that accepts rotary motion, such as that shown. In this configuration handle 8 has a disc-like contour trapped between two fingers of actuating arm 13. The arrangement is further described in FIG. 8.

In the unlocked, first axial position of the lock pin the protrusion or protrusions 7 lie entirely within the longer slot 10. In the locked second axial position part of the protrusions 7 lies within slots 10 and part within slots 9, spanning the clearance gap between adjacent knuckles. Thus the device prevents unwanted rotation of adjacent knuckles when it is locked, thereby locking the hinge and door. Arm 13 and lock cylinder 12 permit the locking/unlocking function to be performed from outside the door.

This invention having been described in its preferred embodiment, it is clear that is susceptible to numerous modifications and embodiments within the ability of those skilled in the art and without the exercise of the inventive faculty. Accordingly the scope of our invention is defined by the scope of the following claims.

We claim:

1. A security hinge having two leaves each for attachment to a door and a door jamb, respectively, said two leaves having at least one knuckle through which a hinge pin may be inserted to permit rotation of the leaves about the hinge pin, the improvement comprising:

a lock pin guide attached to one end of the hinge pin containing a sleeve portion disposed in a parallel orientation to the axis of the hinge pin and laterally spaced therefrom;

a lock pin disposed within the sleeve portion of said lock pin guide and mounted for axial movement relative to said sleeve portion, said lock pin having at least one protrusion adapted to engage complementary formed vertical slots formed in said knuckles, each said protrusion being of a length such that said protrusion may be inserted in the slot formed in a first knuckle when said lock pin is in a first axial position, and may be partially contained in the slot of the first knuckle and partially contained in the slot of the second knuckle adjacent the first knuckle when the lock pin is in a second axial position, thereby preventing relative rotation of the first and second knuckles; and means for retaining said lock pin in the second axial position.

2. The Apparatus of claim 1 wherein said means for retaining said lock pin in the second axial position comprises:

an elastomer plug of free length greater than the inner diameter of the sleeve portion of said lock pin guide, attached to the part of said lock pin which is engaged with the sleeve portion with the free length of said plug perpendicular to the hinge pin;

whereby the ends of said elastomer plug will press against the sleeve portion retaining said lock pin in the first (locked) position yet be overrideable to move said lock pin to the second (unlocked) position and restore normal hinge function.

* * * * *

UNITED STATES PATENT AND TRADEMARK OFFICE

CERTIFICATE OF CORRECTION

PATENT NO. : 4,564,974

DATED : January 21, 1986

INVENTOR(S) : McGrail, John F. and Kershaw, Roger F.

It is certified that error appears in the above-identified patent and that said Letters Patent is hereby corrected as shown below:

On the title page assignee should read

--(73) Assignee: Roger F. Kershaw, Tustin, Calif. --

Signed and Sealed this

*Thirtieth* Day of *September 1986*

[SEAL]

*Attest:*

DONALD J. QUIGG

*Attesting Officer*

*Commissioner of Patents and Trademarks*